US012031270B2

(12) United States Patent
Lindblom et al.

(10) Patent No.: US 12,031,270 B2
(45) Date of Patent: Jul. 9, 2024

(54) REFINER SEGMENT

(71) Applicant: VALMET AB, Sundsvall (SE)

(72) Inventors: Thommy Lindblom, Hägersten (SE); Leonardo Gabriel, Sundbyberg (SE)

(73) Assignee: VALMET AB, Sundsvall (SE)

( * ) Notice: Subject to any disclaimer, the term of this patent is extended or adjusted under 35 U.S.C. 154(b) by 307 days.

(21) Appl. No.: 17/702,113

(22) Filed: Mar. 23, 2022

(65) Prior Publication Data

US 2022/0307199 A1 Sep. 29, 2022

(30) Foreign Application Priority Data

Mar. 24, 2021 (SE) ..... 2150341-2

(51) Int. Cl.
*D21D 1/30* (2006.01)

(52) U.S. Cl.
CPC ..... *D21D 1/306* (2013.01)

(58) Field of Classification Search
CPC ... B02C 7/11; B02C 7/12; D21D 1/30; D21D 1/306
See application file for complete search history.

(56) References Cited

U.S. PATENT DOCUMENTS 5,373,995 A * 12/1994 Johannson ..... D21D 1/306 241/261.3
5,893,525 A * 4/1999 Gingras ..... D21D 1/306 241/261.3
8,573,521 B2 * 11/2013 Gingras ..... D21D 1/306 241/261.3
2019/0071821 A1 * 3/2019 Lindblom ..... D21D 1/306

* cited by examiner

*Primary Examiner* — Bobby Yeonjin Kim
(74) *Attorney, Agent, or Firm* — Foley & Lardner LLP

(57) ABSTRACT

A refiner segment (101; 201) for use in a refiner disc (30; 30*) of a refiner (100) for refining of lignocellulosic material, said refiner segment (1) having an active surface comprising a plurality of bars (10) which are extending over the active surface (2) towards an outer periphery (18*b*) of the refiner segment, wherein at least three of the bars (10) comprises a last-box fluid connection (21) which is a fluid connection provided through the bar (10) for connecting a last box (23*a*) on one side of this bar with a last box (23*a*) on the other side of this bar (10) such that a pressure can be equalized between these two last boxes (23*a*) via the last-box fluid connection (21), wherein said last-box fluid connection (21) is provided in the bar (10) at a distance between 0.0-15.0 mm from the closest last dam (11*a*) which is extending from this bar (10) to another adjacent bar (10).

10 Claims, 6 Drawing Sheets

REFINER SEGMENT

TECHNICAL FIELD

The present invention relates to a refiner segment for use in a refiner disc of a refiner for refining of lignocellulosic material. It relates more specifically to a refiner segment comprising bars and dams, a refiner disc of a refiner comprising such a refiner segment and a refiner comprising a refiner disc equipped with a refiner segment comprising bars and dams.

BACKGROUND

A commonly used refiner of e.g., lignocellulosic material comprises two relatively rotating discs between which the material is refined or defibrated. The pair of relatively rotating discs may in particular comprise one rotating disc, referred to as a rotor, and one static disc, referred to as a stator. Alternatively, the pair of relatively rotating discs may comprise two rotating disc which are rotating in opposite directions. These discs, or at least one of them, are often provided with segments, referred to as refiner segments, whose purpose is to obtain a more efficient refining of the material. A specific type of refiner segments are provided with a set of bars and dams. The bars may be substantially radially extending and protruding structures that are arranged on the active surface of the segment, i.e., the surface of the segment over which the material flows, and are mainly used to achieve an efficient refining of the lignocellulosic material. The dams are also protruding structures provided on the active surface of the refiner segment, but they are not generally provided in a radial direction. The dams are instead provided on the refiner segment in such a way that a particular dam contacts, or connects, two neighbouring bars. That is, a dam is provided so that it spans over a direction that connects two adjacent bars. The direction may be approximately orthogonal to the bars but it can also be provided at an angle with regard to the bars. A particular purpose with the dams is to lift the material that flows in the area between the bars in an upward direction, towards a disc gap defined as the gap between two opposing refiner discs, e.g., the disc gap between a rotor and a stator or the disc gap that separates the two relatively rotating discs. It is in the disc gap between the discs that the material is refined or defibrated. In the common case where each bar connects to one or several dams, a natural consequence of the geometry is that a number of partially enclosed or bounded areas are created between adjacent bars. These areas are referred to as boxes in the detailed description below. The main part of the refining material will flow in these areas. A particular problem associated with refiner segments equipped with bars and dams is that the bars and dams, being structures protruding from the surface of the refiner segment, will be worn down due to the abrasive contact they have with the material to be refined. The efficiency of the refiner segment will as a consequence decrease over time and there will be a need to replace the refiner segment in order to achieve a satisfactory quality of the refined material, e.g., pulp. The invention aims to provide mechanisms that at least alleviate some of the problem that are associated with the wear experienced by refiner segments that are provided with bars and dams.

SUMMARY

An object of the invention is to improve wear resistance in a refiner segment of a refiner caused by material flow on the refiner segment.

A further object of the invention is to provide a refiner segment, a refiner disc comprising a refiner segment and a refiner comprising a refiner disc having improved robustness against wear caused by material flow on the refiner segment.

These objects are achieved by a refiner segment, a refiner disc and a refiner according to the independent claims.

According to a first aspect of the invention a refiner segment for use in a refiner disc of a refiner for refining of lignocellulosic material is provided. Said refiner segment has an active surface which is delimited by an inner periphery, an outer periphery, a first side edge and a second side edge of the refining segment, wherein said active surface comprises:

- a plurality of bars which are extending over the active surface towards the outer periphery of the refiner segment, whereby a plurality of grooves are formed, where each groove is provided between two adjacent bars; and
- a plurality of dams, wherein each of said dams extends between two adjacent bars,
- whereby at least some of the grooves comprise one or more dams separated along an extension of the groove and whereby at least some of the grooves comprise one or more boxes, wherein a box is delimited by two adjacent bars and two adjacent dams provided in the same groove, wherein a last box and a last dam are defined for a groove as a box and a dam respectively which is positioned closest to the outer periphery of the refiner segment in comparison with possible other boxes and dams provided in the same groove,
- wherein at least three of the bars comprises a last-box fluid connection which is a fluid connection provided through the bar for connecting a last box on one side of this bar with a last box on the other side of this bar such that a pressure can be equalized between these two last boxes via the last-box fluid connection, wherein said last-box fluid connection is provided in the bar at a distance between 0.0-15.0 mm from the closest last dam which is extending from this bar to another adjacent bar.

According to a second aspect of the invention there is provided a refiner disc comprising a refiner segment according to the first aspect.

According to a third aspect of the invention there is provided a refiner comprising a refiner disc according to the second aspect.

The invention provides for a refiner segment, and a corresponding refiner disc and refiner, that better withstands the wear caused by the abrasive contact between dams and the material flowing on the refiner segment. This will in turn prolong the effective lifetime of the refiner segment. By providing at least three of the bars with a last-box fluid connection according to the invention a pressure can be equalized between two or more adjacent last boxes which are separated by one or more bars comprising such a last-box fluid connection. Hereby it can be avoided that a higher pressure is provided at specific locations in the refiner segment and thereby cause an uneven wear and possible leakage. Further, by providing this last-box fluid connection close to a last dam of a groove a high individual pressure in a last box of a groove can be avoided whereby the pressure instead is equalized between a number of last boxes. Because a pressure peak will be provided somewhere in a last box this is the most sensitive part of the refiner disc for wear. Hereby, a wear of the refiner disc may according to the invention be more even which is suitable. Furthermore, by equalizing the pressure between more than one last boxes the pressure in each of these last boxes will be less than the previous highest pressure which is suitable and which will provide less wear to the refiner segment and prolong the lifetime of the refiner segment. With the individual pressures in the last boxes equalized between at least some of the last boxes, the likelihood of one individual box being targeted for wear/leakage is much lower. Even further, by providing the last-box fluid connection in the bar as close as possible (i.e. at a distance between 0-15 mm) from the closest last dam which is extending form this bar to another adjacent bar, a risk that a location of a pressure peak within the last boxes on each side of this bar will be provided closer to the outer periphery than the last-box fluid connection is will be very small. A location of the pressure peak will in most cases instead be provided between the last-box fluid connection and the inner periphery of the refiner segment which is suitable because the pressure equalization will then be much more effective. If a pressure peak instead is positioned between the last-box fluid connection and the outer periphery of the refiner segment the pressure would not be equalized or at least not effectively equalized. The pressure peak can in that case prevent fluid equalization between the last boxes. Hereby, the location of the last-box fluid connection which according to the invention is close to the closest last dam (also referred to as line of pressure drop below) is advantageous and provides for efficient pressure equalization and hereby a more uniform wear of the refiner segment.

In some embodiments of the invention the refiner segment is configured to be positioned on a refiner disc such that it cover at least a part of a surface of the refiner disc and such that the inner periphery of the refiner segment is provided closer to a center, C, of the refiner disc than the outer periphery is.

In some embodiments of the invention said refiner segment is a sector of a circle having a central opening.

In one embodiment of the invention a number of bars corresponding to at least half the total number of bars provided in the refiner segment comprises a last-box fluid connection.

In one embodiment of the invention at least every second bar which is a part of a last box comprises a last-box fluid connection.

In one embodiment of the invention at least three adjacent bars each comprises a last-box fluid connection.

In one embodiment of the invention said last-box fluid connection has a width of 0.1-5.0 mm along a length extension of the bar in which it is provided and a depth of 0.1-20.0 mm from an upper surface of the bar in which it is provided.

In one embodiment of the invention at least four last dams provided in adjacent grooves are positioned such that they together form a continuous dam provided along a smooth curve.

Additional advantages will be appreciated when reading the detailed description and dependent claims.

DETAILED DESCRIPTION

Throughout the drawings, the same reference designations are used for similar or corresponding elements. Generally, all terms used herein are to be interpreted according to their ordinary meaning in the relevant technical field, unless a different meaning is clearly given and/or is implied from the context in which it is used. Any feature of any of the embodiments disclosed herein may be applied to any other embodiment, wherever appropriate.

For a better understanding of the invention, it may be useful to begin with a brief description of a general refiner and a short analysis of the technical problems that the invention aims to alleviate.

Figure 1:
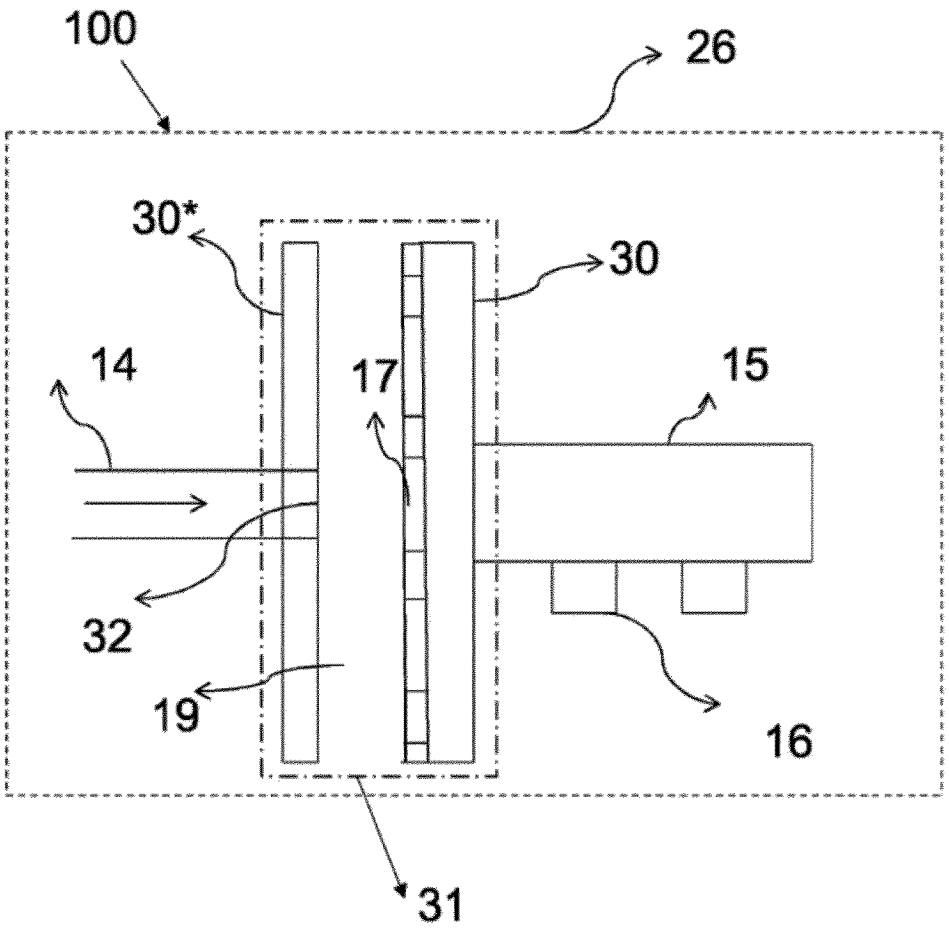
FIG. 1 is a schematic illustration of a refiner wherein the refiner segment according to the invention may be used.
Figure 2:
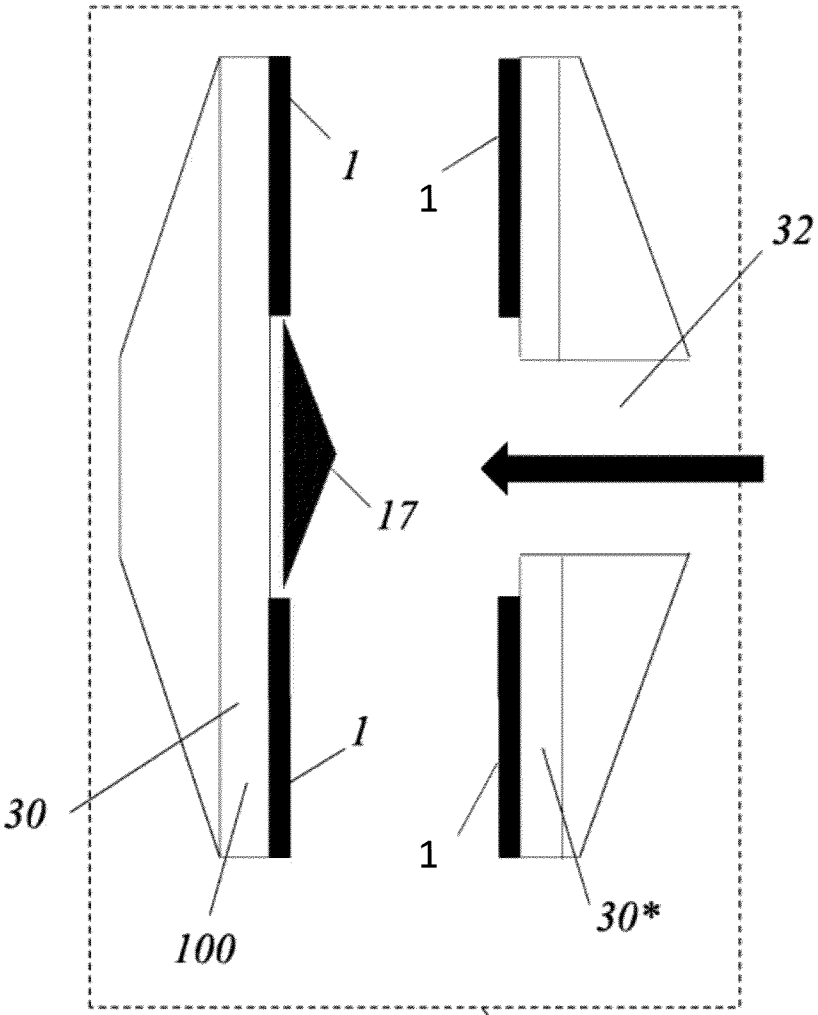
FIG. 2 is a schematic illustration of the cross-section of a refiner disc arrangement wherein the refiner segment according to the invention may be used.

To this end reference is made to FIG. 1 which schematically illustrates a refiner that can utilize the invention. FIG. 1 shows schematically an exemplary pulp refiner 100 in a cross-sectional view. The arrangement is housed in a housing 26 that represents the outer casing of the refiner device together with all components of the device that is not essential for understanding the present invention. Examples of components not shown are an electrical motor for driving e.g. the rotation shaft, the feeding mechanism for the lignocellulosic material etc. Inside a second housing 31 a rotor refiner disc 30 and a stator refiner disc 30* are linearly aligned along a shaft. The rotor refiner disc 30 is attached to a rotation shaft 15 arranged on bearings 16. The rotation shaft 15 is connected to a motor, not shown, that rotates the shaft 15, and thus the rotor refiner disc 30. The stator refiner disc 30* facing the rotor refiner disc 30 can be provided with a centrally located through hole 32 that extends between a feeding channel 14 for lignocellulosic material and a refining area 19. The feeding of material into the refining area 19 need not necessarily be provided via a centrally located through hole as shown in FIGS. 1 and 2 but can instead be distributed via through holes distributed in another way than exactly centrally. The rotor refiner disc 30 can in certain embodiments be provided with a center plate 17 having a surface facing the incoming flow of lignocellulosic material. The surface of the center plate 17 can be provided with structures that will direct the lignocellulosic material outwards. The rotor refiner disc 30* and/or the stator refiner disc 30 are provided with refiner segments to enable steering and grinding of the pulp. These refiner segments can be provided with bars and dams which will be described in more details below. In some refiners there may be two rotor refiner discs instead of a rotor and a stator refiner disc, where the two rotor refiner discs are rotated in opposite directions. The present invention can be applied also in such refiners.

During use, lignocellulosic material such as wood chips or prepared wood, e.g., pulp, will be fed by means of a feeding mechanism, such as a screw feeder, not shown, through the feeding channel 14. The material will pass through the hole 32 in the stator refiner disc 30* and enter an area 19. The area 19 is essentially defined by the open area between the rotor 30 and the stator refiner disc 30* and this area can be quite small during operation. The lignocellulosic material flowing into the area 19 will be incident on the center plate 17 on the rotor refiner disc 30. The center plate 17 acts to steer the lignocellulosic material out towards the refiner segments on the rotor and/or stator refiner disc.

In order to provide a more detailed description of a rotor-stator arrangement in which the invention may be used reference is made to FIG. 2. FIG. 2 illustrates a cross-sectional side view of a rotor-stator arrangement housed in a housing 31 in a refiner as e.g., described above. Shown is a rotor refiner disc 30, that is arranged to rotate around a rotation shaft and a stator refiner disc 30*. The rotor refiner disc 30 is provided, on the surface facing the stator refiner disc 30*, with at least one refiner segment 1. The stator refiner disc 30* may also be provided, on the surface facing the rotor refiner disc 30, with at least one refiner segment 1. These refiner segments 2 provided on the rotor refiner disc 30 and the stator refiner disc 30* respectively may or may not be equally designed. The refiner segment according to the invention may be provided to either one or both of the rotor and stator refiner discs 30, 30* or one or both of two rotor refiner discs in the case of two rotating discs. The rotor and stator refiner discs may in certain versions of a refiner be referred to as segment holders since one of the purposes of the refiner discs are to carry refiner segments 1. Also illustrated in FIG. 2 is an inlet 32 for the lignocellulosic material subject to refining.

The inlet 32 is arranged in a central area of the stator refiner disc 30*, however, a central location of the inlet 32 is not necessary as discussed above. Arranged in a center area of the rotor refiner disc 30, opposing the inlet 32, is a center plate 17. The purpose of the center plate 17, which was described above with reference to FIG. 1, is to distribute material that falls in from the inlet 32 towards the outer sections of the rotor refiner disc 30. That is, the center plate 17 acts to distribute the material towards the refiner segments 1 arranged on the rotor refiner disc 30. In examples comprising two rotor refiner discs which are rotating in opposite directions, inlets for feeding of material may be arranged differently as commonly known within this art.

Figure 3:
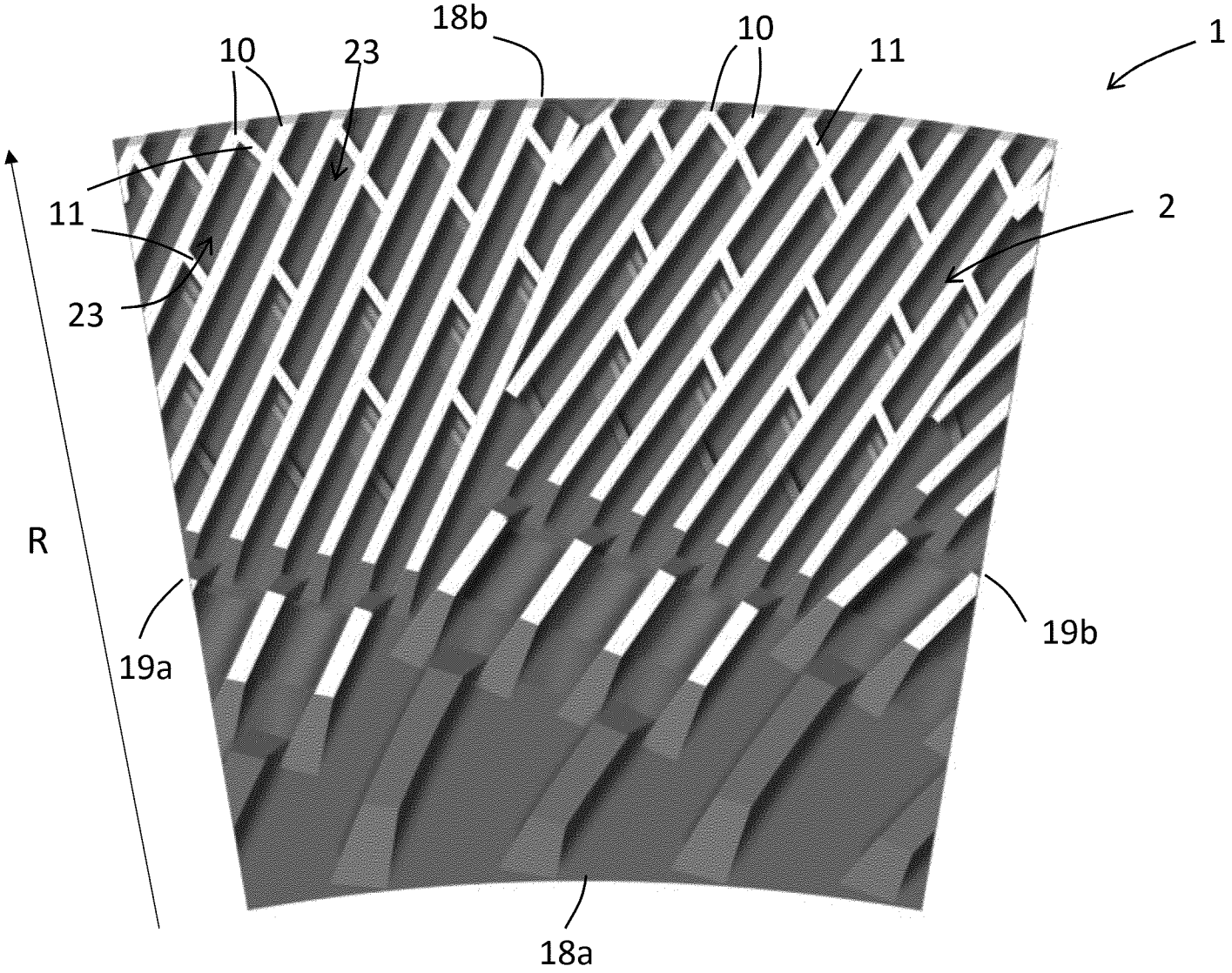
FIG. 3 is a schematic illustration of a known refiner segment as viewed from above.

A general refiner that can utilize the invention has now been described above in relation to FIGS. 1 and 2. FIG. 3 provides a schematic illustration of an example of a refiner segment 1. The refiner segment 1 is to be provided to a refiner disc 30. This can be both a rotor refiner disc 30 and a stator refiner disc 30* but will only be referred to as refiner disc 30 hereafter. The refiner segment 1 consists in this particular example of a circular sector. There are other versions of refiner segments, the invention however functions equally well for all particular refiner segment shapes. The refiner segment 1 is provided in the shape of a segment to be attached to a refiner disc 30. A refiner segment 1 may be provided in the shape of a circle, optionally with a removed central area for leaving room for a center plate 17 or an inlet 32 as described above. A refiner segment 1 may also be provided in the shape of a sector of a circle where the circle optionally has a removed central area or in the shape of another part of a circle. A refiner disc 30 may thus be provided with a number of refiner segments 1 whereby it will either be completely covered by refiner segments 1 or partially covered. In case the refiner segment 1 form part of a rotor refiner disc 30, the center area of the rotor refiner disc may comprise a center plate 17 as described above.

FIG. 3 illustrates a refiner segment 1 having an inner periphery 18*a* and an outer periphery 18*b*. The inner periphery 18*a* is the periphery of the refiner segment 1 that is intended to be closest to a center, C, of the refiner disc 30 when the refiner segment 1 has been attached thereto. The refiner segment 1 comprises an active surface 2 which is provided with a number of bars 10. The bars are extending over the active surface towards the outer periphery 18*b* of the refining segment 1. The bars 10 may be substantially radially extending and run in a nearly parallel fashion along the active surface, i.e. the surface facing the material flow, of the refiner segment. However, the bars 10 may also be provided in directions deviating somewhat from a radial extension and they may not all be running in parallel as can be seen in FIG. 3 and which is commonly known in this technical area. Also shown is a number of dams 11 which may be provided substantially orthogonally directed with regard to the bars 10 but which may also be provided with an inclination to the bars 10, and where each dam 11 connects to both bars 10 in a pair of adjacent bars 10. The arrangement of bars 10 and dams 11 defines delimited sections, bounded by two adjacent bars 10 and two dams 11, called boxes 23.

Figure 4:
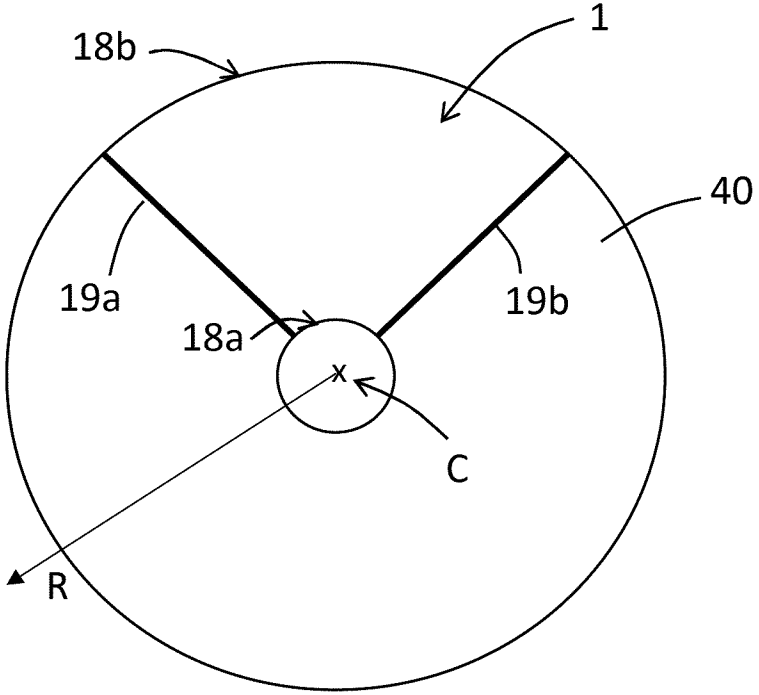
FIG. 4 is a schematic illustration of a known refiner segment attached to a refiner disc such a rotor disc or a stator disc.

FIG. 4 is a simplified view of the refiner segment 1 in FIG. 3 when attached to a refiner disc 30 of a stator or a rotor, having a center C. The radial direction is illustrated by means of an arrow denoted R. The radial direction extends from the center C of the refiner disc 30 toward the periphery of the refiner disc 30, passing on its way through the inner 18*a* and outer 18*b* peripheries of the refiner segment 1.

With reference to FIG. 3 again. During use of the refiner segment 1 the main part of the lignocellulosic material will flow in grooves 19 provided between the bars 10. When the material flows towards the outer periphery 18*b* of the refiner segment 1 it will impinge on dams 11 provided in the grooves 19 and be lifted up towards the disc gap, as was explained earlier. The interaction between the flowing material and the dams 11 and bars 10 will cause a lot of wear on the dams 11 and bars 10 and may in time destroy at least part of them thereby rendering the refiner segment 1 less effective. The boxes 23 may each have separate and different pressures which may lead to a non-uniform wear where boxes 23 having the largest pressure will be most affected. Especially a last box 23*a* in radial direction, R, in each groove 19 may be effected by wear because there will be a pressure peak in these last boxes 23*a*. The pressure in the last box 23*a* of each groove 19 will have the highest pressure. However, the pressure of the last box 23*a* will be individual for each groove 19. The last box 23*a* with highest individual pressure will be most affected by wear. If only one or some of the last boxes 23*a* are much more effected by wear or even destroyed the refiner segment 1 will not work appropriately. The lignocellulosic material will not be effectively and evenly refined and the whole refiner segment 1 will need to be changed.

Figure 5:
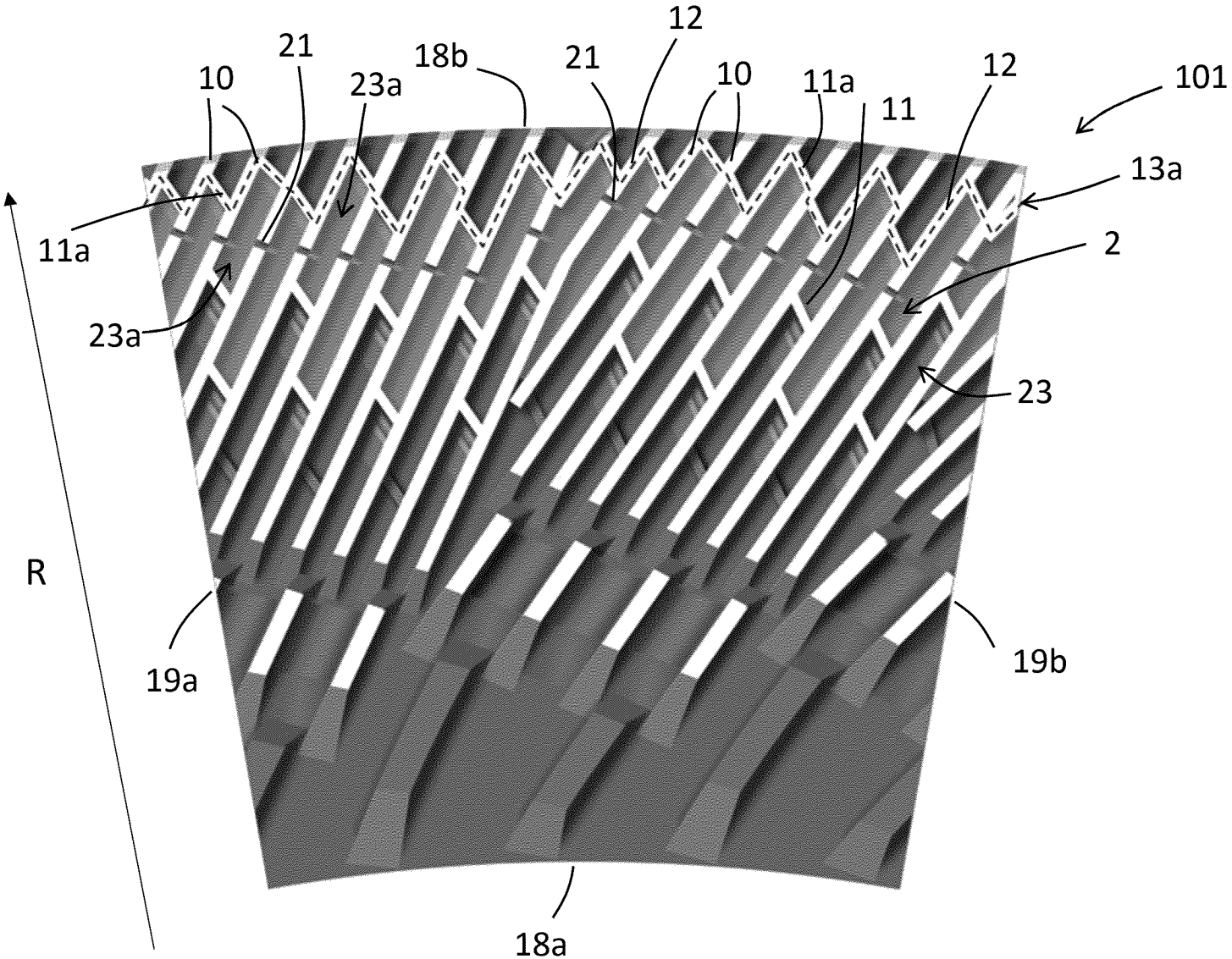
FIG. 5 is a schematic illustration of a refiner segment according to one embodiment of the invention.
Figure 6:
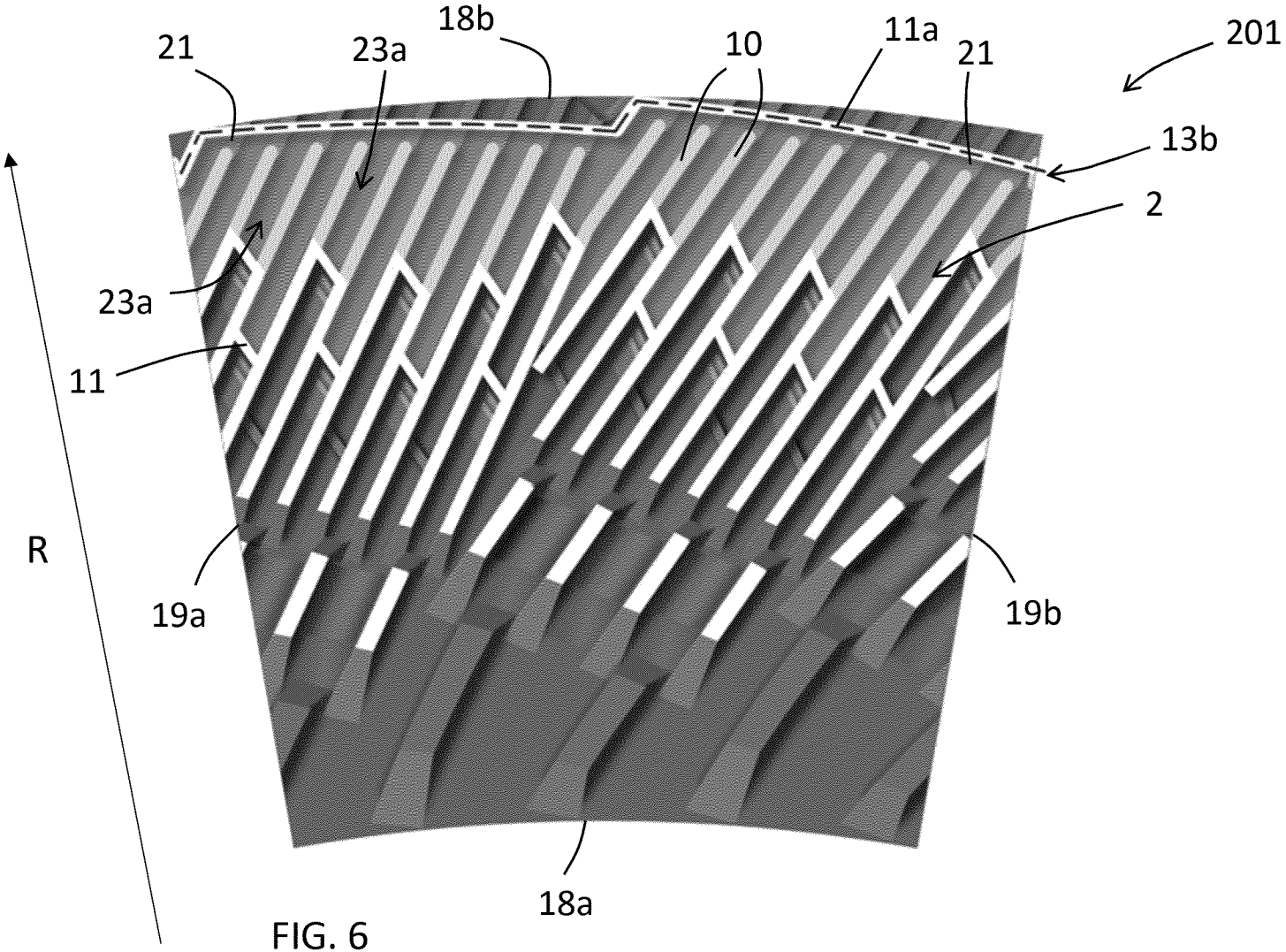
FIG. 6 is a schematic illustration of a refiner segment according to another embodiment of the invention.

FIG. 5 is a schematic illustration of a refiner segment 101 according to one embodiment of the invention. FIG. 6 is a schematic illustration of a refiner segment 201 according to another embodiment of the invention. Many of the details are the same as already described in relation to FIG. 3 and these details are given the same reference numbers and will not be described in detail again.

Referring to both FIGS. 5 and 6, a refiner segment 101; 201 for use in a refiner disc 30; 30* of a refiner 100 for refining of lignocellulosic material is provided. Said refiner segment 101; 201 has an active surface 2 which is delimited by an inner periphery 18*a*, an outer periphery 18*b*, a first side edge 19*a* and a second side edge 19*b* of the refining segment 101; 201. When the refiner segment 101; 201 is attached to a refiner disc 30, 30* the inner periphery 18*a* will be positioned closest to a center, C, of the refiner disc, while the outer periphery 18*b* will be positioned further away from the center, C, i.e. at a larger radial distance from the center, C than the inner periphery 18*a*. In this example the refiner segment is a sector of a circle where the circle has an open center. A number of such refiner segments will hereby be needed to cover a surface of the refiner disc 30, 30*. However, a refiner segment can also have another geometry.

The active surface 2 comprises a plurality of bars 10 which are extending over the active surface 2 towards the outer periphery 18*b* of the refiner segment, whereby a plurality of grooves 19 are formed, where each groove 19 is provided between two adjacent bars 10. The material to be refined in the refiner is transported along the grooves 19 towards the outer periphery 18*b* of the refiner segment 101; 201. At least some of the bars 10 are extending substantially in parallel to each other. At least some of the bars 10 may extend over the active surface 2 along a direction between the inner periphery 18*a* and the outer periphery 18*b* of the refiner segment. However, this may not be the case for all the bars 10. The active surface 2 further comprises a plurality of dams 11, wherein each of said dams 11 extends between two adjacent bars 10. A groove 19 may comprise one or more dams 11 separated along an extension of the groove 19. Hereby essentially boxed shaped regions, called boxes 23 are formed in areas defined by neighbouring bars 10 and at least two dams 11. A groove 19 may comprise one or more boxes 23, wherein a box 23 is delimited by two adjacent bars 10 and two adjacent dams 11 provided in the same groove 19. A last box 23*a* and a last dam 11*a* are defined for a groove 19 as a box 23 and a dam 11 respectively which is positioned closest to the outer periphery 18*b* of the refiner segment in comparison with possible other boxes 23 and dams 11 provided in the same groove 19. In grooves 19 where only one box 23 or only one dam 11 is provided this is defined as the last box 23*a* and the last dam 11*a* respectively.

According to the invention at least three of the bars 10 comprises a last-box fluid connection 21 which is a fluid connection provided through the bar 10 for connecting a last box 23*a* on one side of this bar with a last box 23*a* on the other side of this bar 10 such that a pressure can be equalized between these two last boxes 23*a* via the last-box fluid connection 21. Said last-box fluid connection 21 is provided in the bar 10 at a distance between 0.0-15.0 mm from the closest last dam 11*a* which is extending from this bar 10 to another adjacent bar 10. In another embodiment of the invention the last-box fluid connection 21 is provided in the bar 10 at a distance between 0.0-10.0 mm from the closest last dam 11*a* which is extending from this bar 10 to another adjacent bar 10.

As discussed above there will be a pressure peak in the refiner segment when used in a refiner for refining material. The pressure peak will be located somewhere in the last boxes 23*a*. The last dams 11*a* in the grooves 19 will together with sections 12 of the bars 10 which are connecting the last dams 11*a* constitute a barrier which is separating the pressure in between the two refiner discs 30, 30* from a pressure at the refiner segment exit which is the same as a refiner housing pressure. This barrier is called a line of pressure drop 13*a* and is marked in FIG. 5 with a dotted line 13*a*. Without a last-box fluid connection 21 according to the invention the pressures are individual in each last box 23*a* and the risk of wear and leakage over the line of pressure drop 13*a* will be highest in the last box 23*a* having the highest pressure. By including last-box fluid connections 21 in at least some of the bars 10 a pressure in the last boxes 23*a* will be equalized between at least some of the last boxes 23*a* which will be advantageous. With a more equalized pressure the highest pressure will be smaller and a wear over the refiner segment will be more evenly distributed.

In the embodiment shown in FIG. 5 all the bars 10 which are part of a last box 23*a* comprise a last-box fluid connection 21. There may be other bars in a refiner segment which are not part of last boxes 23*a*, as for example illustrated in FIG. 5 where there are some shorter bars provided closer to the inner periphery 18*a* of the refiner segment. Hereby such bars which are not reaching out to the outer periphery 18*b* of the refiner segment 101 do not need a fluid connection. Furthermore, all the bars 10 which do reach out to the outer periphery 18*b* and which are a part of a last box 23*a* do not need to comprise a last-box fluid connection 21 even though this is shown in FIG. 5. According to the invention at least three of the bars 10 comprises a last-box fluid connection 21. In one embodiment of the invention a number of bars 10 corresponding to at least half the total number of bars 10 provided in the refiner segment comprises a last-box fluid connection 21. In another embodiment of the invention at least every second bar 10 which is a part of a last box 23*a* comprises a last-box fluid connection 21. In still a further embodiment of the invention at least three adjacent bars 10 each comprises a last-box fluid connection 21. In still a further embodiment of the invention at least five adjacent bars 10 each comprises a last-box fluid connection 21.

In some embodiments of the invention said last-box fluid connection 21 has a width of 0.1-5.0 mm along a length extension of the bar 10 in which it is provided and a depth of 0.1-20.0 mm from an upper surface of the bar 10 in which it is provided.

FIG. 6 shows another embodiment of a refiner segment 201 according to the invention. Most of the details are the same as the details of the embodiment described in relation to FIG. 5 and are also given the same reference numbers and will not be described again. In this embodiment of the invention at least four last dams 11*a* provided in adjacent grooves 19 are positioned such that they together form a continuous dam provided along a smooth curve. This continuous dam will thus constitute a line of pressure drop 13*b* which in this case is provided along a smooth curve in contrast to the line of pressure drop 13*a* provided in the refiner segment 101 of FIG. 5. Hereby, weak points which may be provided in a corner of the line of pressure drop 13*a* of the refiner segment 101 as shown in FIG. 5*a*, i.e. a corner between a last dam 11*a* and a segment 12 of a bar which is connecting this last dam 11*a* with another last dam 11*a*, can be avoided. Such corners may be more affected by a pressure difference and may be exposed to more wear and therefore a leakage may start in such a corner more often than at other positions. The continuous dam along a smooth curve according to the refiner segment 201 shown in FIG. 6 does not comprise such corners and comprises hereby less weak points. Furthermore, the last-box fluid connections 21 can in a construction as shown in FIG. 6, easily be provided very close to the line of pressure drop 13*b*. The last-box fluid connections 21 can be provided to the bars 10 along a line or curve which corresponds to the line of pressure drop 13*b* but just positioned a few millimetres closer to the inner periphery 18*a* than the line of pressure drop 13*b*. In one embodiment the distance between the line of pressure drop 13*b* and the position of the last-box fluid connection 21 is 0-15 mm and in another embodiment the distance is 0-10 mm. By positioning the last-box fluid connection 21 close to the line of pressure drop 13*b* it can be avoided, or at least a risk can be very much decreased, that the pressure peak will be positioned in between the last-box fluid connection 21 and the line of pressure drop 13*b*. Hereby the pressure equalisation will be more effective.

In the embodiment shown in FIG. 6 there are 8-9 last dams 11*a* which are positioned to form a continuous dam which is provided along a smooth curve. The number of last dams 11*a* which are positioned to form a continuous dam can however be varied. According to the invention at least four last dams are positioned to form a continuous dam which is provided along a smooth curve.

According to the invention a refiner disc 30, 30* is also provided comprising at least one refiner segment 101; 201 according to the invention. Said refiner disc 30, 30* can be a rotor disc or a stator disc. According to the invention a refiner 100 for refining of lignocellulosic material is also provided. Said refiner comprises a refiner disc 30, 30* comprising at least one refiner segment 101; 201 according to the invention.

The invention claimed is:

1. A refiner segment (101; 201) for use in a refiner disc (30; 30*) of a refiner (100) for refining of lignocellulosic material, the refiner segment (1) having an active surface (2) which is delimited by an inner periphery (18*a*), an outer periphery (18*b*), a first side edge (19*a*) and a second side edge (19*b*) of the refining segment (1), wherein the refiner segment comprises, at the active surface (2):

a plurality of bars (10) that extends over the active surface (2) towards the outer periphery (18*b*) of the refiner segment, wherein the plurality of bars define a plurality of grooves (19), wherein each of the grooves (19) is defined by two adjacent bars (10); and a plurality of dams (11), wherein each of the dams (11) extends between two adjacent bars (10), wherein:

at least some of the grooves (19) comprise a plurality of the dams (11) separated from one another along an extension of the groove (19), at least some of the grooves (19) comprise one or more boxes (23), wherein each box (23) is delimited by two adjacent bars (10) and two adjacent dams (11) provided in the same groove (19), wherein a last box (23*a*) and a last dam (11*a*) are defined as a box (23) and a dam (11) that are positioned closest to the outer periphery (18*b*) of the refiner segment in comparison with any other boxes (23) and dams (11) provided in the same groove (19), each of at least three adjacent ones of the bars (10) comprises a last-box fluid connection (21), which is a fluid connection provided through the bar (10) that connects a last box (23*a*) on one side of this bar with a last box (23*a*) on the other side of this bar (10) such that a pressure can be equalized between these two last boxes (23*a*) via the last-box fluid connection (21), wherein the last-box fluid connection (21) is provided in the bar (10) at a distance between 0.0-15.0 mm from the closest last dam (11*a*) that extends from this bar (10) to another adjacent bar (10).

2. The refiner segment according to claim 1, wherein the refiner segment is configured to be positioned on a refiner disc (30, 30*) such that the refiner segment covers at least a part of a surface of the refiner disc and such that the inner periphery (18*a*) of the refiner segment is provided closer to a center (C) of the refiner disc than the outer periphery (18*b*) is.

3. The refiner segment according to claim 1, wherein the refiner segment (1) is shaped as a sector of a circle having a central opening.

4. The refiner segment according to claim 1, wherein a number of bars (10) corresponding to at least half a total number of bars (10) provided in the refiner segment comprises a last-box fluid connection (21).

5. The refiner segment according to claim 1, wherein at least every second bar (10) which is a part of a last box (23*a*) comprises a last-box fluid connection (21).

6. The refiner segment according to claim 1, wherein each last-box fluid connection (21) has a width of 0.1-5.0 mm along a length extension of the bar (10) in which it is provided and a depth of 0.1-20.0 mm from an upper surface of the bar (10) in which it is provided.

7. The refiner segment according to claim 1, wherein at least four last dams (11*a*) provided in adjacent grooves (19) are positioned such that they together form a continuous dam provided along a smooth curve.

8. A refiner disc (30, 30*) comprising at least one refiner segment (101; 201) according to claim 1.

9. The refiner disc (40) according to claim 8, wherein the refiner disc (30, 30*) is a rotor disc or a stator disc.

10. A refiner (100) for refining of lignocellulosic material, the refiner comprising a refiner disc (30, 30*) according to claim 8.

* * * * *